US008820793B2

(12) United States Patent
Lister

(10) Patent No.: US 8,820,793 B2
(45) Date of Patent: Sep. 2, 2014

(54) SECURITY DEVICES

(75) Inventor: Adam Lister, Andover (GB)

(73) Assignee: De La Rue International Limited, Basingtoke, Hampshire (GB)

( * ) Notice: Subject to any disclaimer, the term of this patent is extended or adjusted under 35 U.S.C. 154(b) by 56 days.

(21) Appl. No.: 13/504,607

(22) PCT Filed: Oct. 29, 2010

(86) PCT No.: PCT/GB2010/002008
§ 371 (c)(1),
(2), (4) Date: May 21, 2012

(87) PCT Pub. No.: WO2011/051682
PCT Pub. Date: May 5, 2011

(65) Prior Publication Data

US 2013/0113200 A1 May 9, 2013

(30) Foreign Application Priority Data

Oct. 30, 2009 (GB) ..... 0919138.8

(51) Int. Cl.
*B42D 15/00* (2006.01)

(52) U.S. Cl.
USPC ..... 283/91; 283/72; 283/114

(58) Field of Classification Search
CPC ..... B42D 2033/26
USPC ..... 283/72
See application file for complete search history.

(56) References Cited

U.S. PATENT DOCUMENTS

| | | | | |
|---|---|---|---|---|
| 4,893,906 | A | 1/1990 | Makow | |
| 5,089,318 | A | 2/1992 | Shetty et al. | |
| 2007/0211238 | A1* | 9/2007 | Hoffmuller et al. | 356/71 |
| 2007/0216518 | A1* | 9/2007 | Hoffmuller | 428/395 |
| 2007/0241553 | A1* | 10/2007 | Heim et al. | 283/72 |
| 2010/0308570 | A1* | 12/2010 | Heim | 283/72 |

FOREIGN PATENT DOCUMENTS

| | | | |
|---|---|---|---|
| AU | 488652 | | 9/1974 |
| DE | 102008009296 | A1 | 8/2009 |
| EP | 0059056 | A1 | 9/1982 |
| EP | 0435029 | A2 | 7/1991 |
| EP | 0860298 | A2 | 8/1998 |
| EP | 1047549 | B1 | 11/2000 |

(Continued)

OTHER PUBLICATIONS

International Search Report from corresponding International Application No. PCT/GB2010/002008 dated Mar. 17, 2011.

(Continued)

*Primary Examiner* — Kyle Grabowski
(74) *Attorney, Agent, or Firm* — Ohlandt, Greeley, Ruggiero & Perle, LLP

(57) ABSTRACT

Improvements in security devices are provided that are used for authenticating or security applications. The security device includes a first color-shifting layer and a second color-shifting layer, which exhibits different reflective characteristics to the first color-shifting layer. A partial first light absorbing layer is between first surfaces of the first and second color-shifting layers and a second light absorbing layer applied to a second surface of the second color-shifting layer. The color of the partial first absorbing layer is selected to substantially match the color of light reflected at a normal angle of incidence by the combination of the second color-shifting layer and the second absorbing layer.

35 Claims, 3 Drawing Sheets

(56) References Cited

FOREIGN PATENT DOCUMENTS

Figure 1:
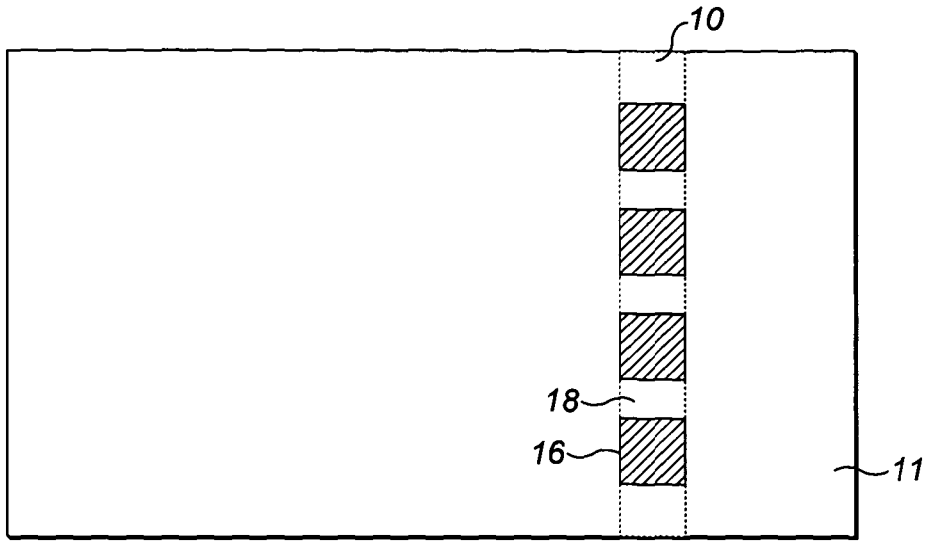

| | | | |
|---|---|---|---|
| EP | 1141480 | B1 | 10/2001 |
| EP | 1156934 | B1 | 11/2001 |
| EP | 1771752 | | 4/2007 |
| GB | 2442711 | A | 4/2008 |
| GB | 2454752 | | 5/2009 |
| WO | 9619347 | A2 | 6/1996 |
| WO | 03054297 | A2 | 7/2003 |
| WO | 03061980 | A1 | 7/2003 |
| WO | 03095188 | A2 | 11/2003 |
| WO | 2005105474 | A2 | 11/2005 |
| WO | 2008043981 | A1 | 4/2008 |

OTHER PUBLICATIONS

Written Opinion from corresponding International Application No. PCT/GB2010/002008 dated Mar. 17, 2011.

Great Britain Search Report dated Nov. 27, 2009 for Great Britain application No. GB0919138.8.

* cited by examiner

SECURITY DEVICES

The present invention relates to improvements in security devices that can be used in for various authenticating or security applications, and in particular to an optically variable security device utilising multiple colour shift layers.

The increasing popularity of colour photocopiers and other imaging systems and the improving technical quality of colour photocopies has led to an increase in the counterfeiting of banknotes, passports and identification cards and the like. There is, therefore, a need to add additional authenticating or security features to existing security features. Steps have already been taken to introduce optically variable features into substrates used in such documentation that cannot be reproduced by a photocopier. There is also a demand to introduce features which are discernible by the naked eye but which are "invisible" to, or viewed differently, by a photocopier. Since a photocopying process typically involves scattering high-energy light off an original document containing the image to be copied, one solution would be to incorporate one or more features into the document which have a different perception in reflected and transmitted light, an example being watermarks and enhancements thereof.

It is known that certain liquid crystal materials exhibit a difference in colour when viewed in transmission and reflection, as well as an angularly dependent coloured reflection. Liquid crystal materials have been incorporated into security documents, identification cards and security elements with a view to creating distinctive optical characteristics. EP-A-0435029 is concerned with a data carrier, such as an identification card, which comprises a liquid crystal polymer layer or film in the data carrier. The liquid crystal polymer is solid at room temperature and is typically held within a laminate structure. The intention is that the liquid crystal layer, which is applied to a black background, will demonstrate a high degree of colour purity in the reflected spectrum for all viewing angles. Automatic testing for verification of authenticity is described using the wavelength and polarization properties of the reflected light in a single combined measurement. This has the disadvantage of being optically complex using a single absolute reflective measurement requiring a uniform liquid crystal area on a black background.

AU-A-488,652 is also concerned with preventing counterfeit copies by introducing a distinctive optically-variable feature into a transparent window security element. This document discloses the use of a liquid crystal "ink" laminated between two layers of plastic sheet. The liquid crystal is coated on a black background so that only the reflected wavelengths of light are seen as a colour. The security feature is primarily provided by thermochromic liquid crystal materials, which have the characteristic of changing colour with variation in temperature.

Liquid crystal materials can be incorporated into security devices either as a film, as for example in WO-A-03061980, or in the form of an ink as a liquid crystal pigment in an organic binder, as for example in EP-A-1156934. The advantage of a liquid crystal ink is that it can be applied using conventional printing processes and therefore it is relatively straightforward to apply the liquid crystal material in the form of a design. However the colour purity, brightness and sharpness of the observed colour and colour-shift are significantly degraded for a pigmented liquid crystal ink compared to a liquid crystal film. This degradation is due to the variability in alignment of the cholesteric helical axis between the individual liquid crystal pigments compared to the uniform alignment of the liquid crystal film.

A method of increasing the range of available colours in liquid crystal films is described in U.S. Pat. No. 4,893,906, in which two or more liquid crystal coatings are overlaid to obtain new colours as a result of the colour additive properties of the liquid crystal coatings which do not absorb light. WO-A-2005105474 describes a security device comprising two superimposed cholesteric liquid crystal layers in which the additive mixing of the colours permits a wider range of colourshift effects. In some of the embodiments in WO-A-2005105474 regions exhibiting different colourshifting effects are created by a partial application of one of the liquid crystal layers in localised areas. A partial application of a liquid crystal film is not straightforward and increases significantly the complexity of the production process compared to simply applying one uniform film over a second uniform film.

WO-A-2008/043981 describes an improved security device which incorporates two layers of optically variable liquid crystal materials which have different reflective properties and a partial layer of a light absorbing material between the liquid crystal layers. This creates two optically variable regions having a different appearance.

It has been found that multilayer polymer films provide a colourshift effect which is comparable to that of liquid crystals, yet are sufficiently strong to be self supporting. Such films are described in EP-A-1047549, US-B-5089318 and WO-A-9619347 and are formed of multiple layers (hundreds or thousands) of at least two different materials. The various layers may have different actual and/or optical thickness and different indices of refraction. These films contain no dye or pigment or other element which may fade in time, as they just use selective reflection to provide the colourshift effect. As incident white lights strikes the film, light of a specific wavelength is reflected whilst other wavelengths are transmitted through the layers to be reflected at different angles to the normal. Thus when viewed at different angles of light different colours can be seen.

As described in EP-A-1047549 the layers may be selected so that light in the non-visible (infra-red) part of the electromagnetic spectrum is reflected at normal incidence, and the film thus appears substantially transparent. As the film is tilted away from normal it reflects a visible colour (e.g. red).

It is an object of the present invention to provide an improved optically variable security device which has a distinctive and easily recognisable colourshifting security feature.

The present invention provides a security device comprising a first colourshifting layer, a second colourshifting layer which exhibits different reflective characteristics to the first colourshifting layer, said colourshifting layers exhibiting a visible colour at normal incidence, a partial first light absorbing layer between first surfaces of the first and second colourshifting layers and a second light absorbing layer applied to a second surface of the second colourshifting layer, wherein the colour of the partial first absorbing layer is selected to substantially match the colour of light reflected at a normal angle of incidence by the combination of the second colourshifting layer and the second absorbing layer.

The present invention further provides a security device comprising a first colourshifting layer, a second colourshifting layer which exhibits different reflective characteristics to the first colourshifting layer, said second colourshifting layer being a multilayer polymer film, a partial first light absorbing layer between first surfaces of the first and second colourshifting layers and a second light absorbing layer applied to a second surface of the second colourshifting layer, wherein the colour of the partial first absorbing layer is selected to substantially match the colour of light reflected at a normal angle of incidence by the combination of the second coloursHifting layer and the second absorbing layer.

A preferred embodiment of the present invention will now be described, by way of example only, with reference to the accompanying drawings, in which:—

Figure 2A:
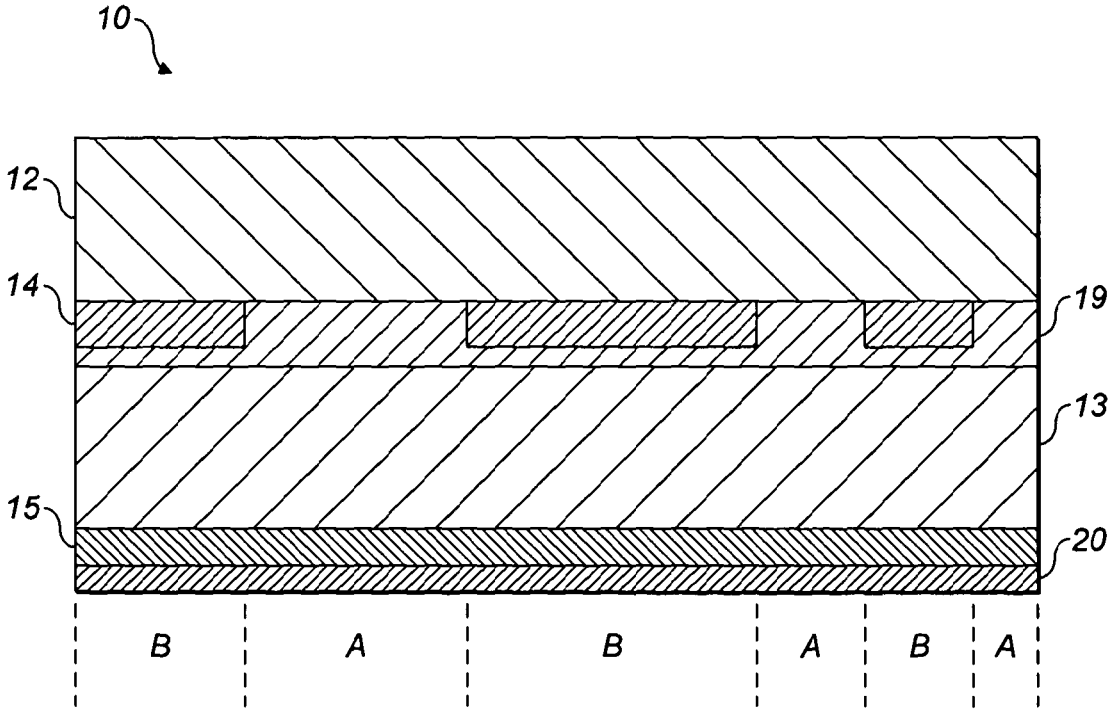
Figure 2B:
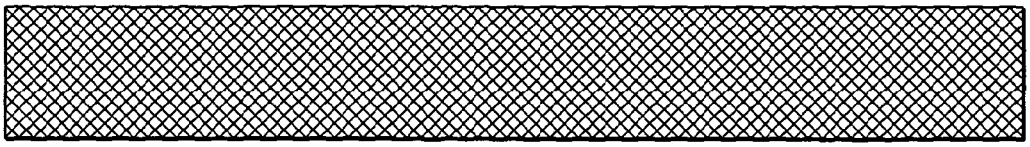
Figure 2C:
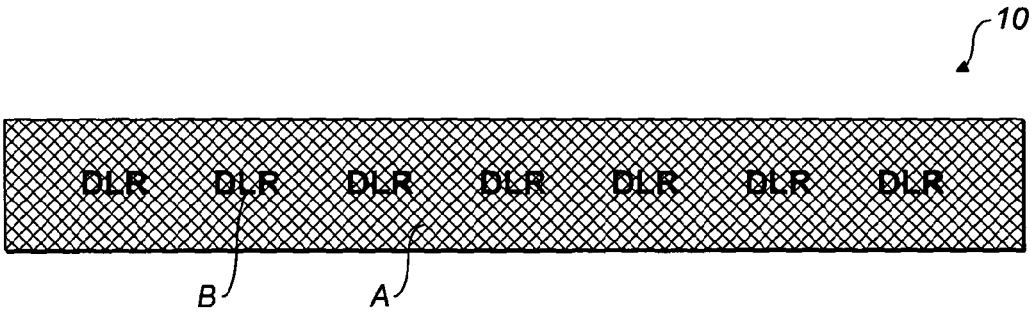
Figure 2D:
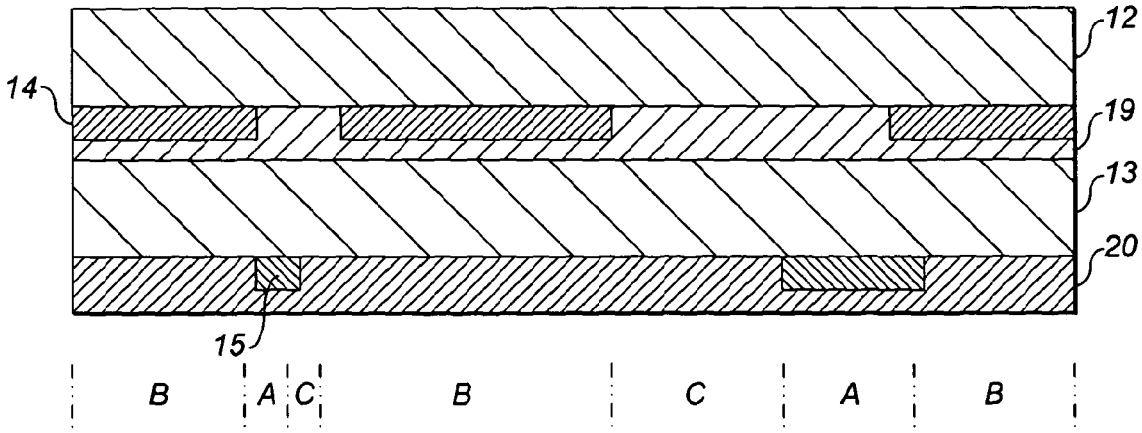
Figure 3:
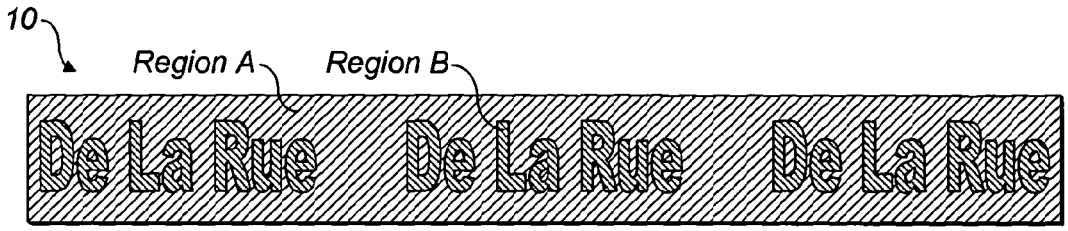
Figure 4:
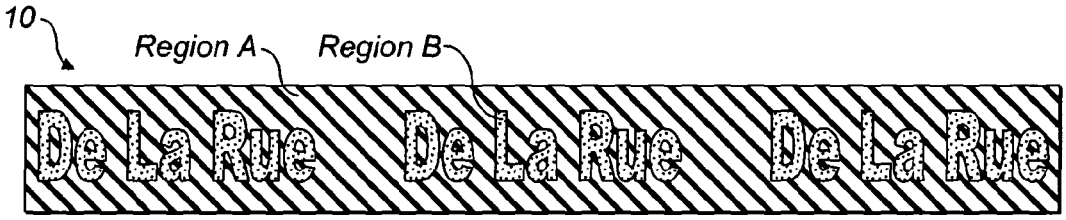

FIG. 1 is a plan view of a security document incorporating a partially embedded security device of the present invention;

FIG. 2*a* is a cross-sectional side elevation of a security device of the present invention;

FIGS. 2*b* and 2*c* are plan views of another embodiment of a security device of the present invention when viewed in reflective light at normal incidence and tilted away from normal incidence respectively;

FIG. 2*d* is a cross sectional side elevation of yet another embodiment of the present invention;

FIGS. 3 and 4 are plan views of an alternative embodiment of the present invention viewed in reflected light at normal incidence and tilted away from normal incidence respectively.

Referring to FIG. 1, the present invention provides a security device 10 for protecting a document of value 11. As shown in FIG. 2, the security device 10 comprises a first coloursHifting layer 12 and a second coloursHifting layer 13 which exhibits different reflective characteristics to the first coloursHifting layer 12. A first partial layer 14 of a light absorbing material is applied between the first and second coloursHifting layer 12, 13 and a second layer 15 of a light absorbing material is applied to the exposed surface of the second coloursHifting layer 13.

The security device 10 can be incorporated into secure documents 11 in any of the conventional formats known in the prior art, for example as patches, foils, stripes, strips or threads. The security device 10 can be arranged either wholly on the surface of the document 11, as in the case of a stripe or patch, or can be visible only partly on the surface of the document 10 in the form of a windowed security thread. Security threads are now present in many of the world's currencies as well as vouchers, passports, travellers' cheques and other documents. In many cases the thread is provided in a partially embedded or windowed fashion where the thread appears to weave in and out of the paper and is visible in windows 16 in one or both surfaces of the document 11. One method for producing paper with so-called windowed threads can be found in EP-A-0059056. EP-A-0860298 and WO-A-03095188 describe different approaches for the embedding of wider partially exposed threads into a paper or other substrate. Wide threads, typically having a width of 2-6 mm, are particularly useful as the additional exposed thread surface area allows for better use of optically variable devices, such as that used in the present invention. FIG. 1 shows the security device 10 of the present invention incorporated into a security document 11 as a windowed thread with windows 16 in which the security document 10 is exposed and areas 18 in which the security device is embedded within the substrate of the document 11.

In a further embodiment of the invention (not shown) the device 10 is incorporated into the document 11 such that regions of the device 10 are viewable from both sides of the document 11. Methods of incorporating a security device such that it is viewable from both sides of the document 11 are described in EP-A-1141480 and WO-A-3054297. In the method described in EP-A-1141480 one side of the device 10 is wholly exposed at one surface of the substrate in which it is partially embedded, and partially exposed in windows 11 at the other surface of the substrate.

In the case of a stripe or patch, the security device 10 may be prefabricated on a carrier strip 17 and transferred to the substrate in a subsequent working step. The security device 10 can be applied to the document using an adhesive layer, which is applied either to the security device 10 or the surface of the security document 11 to which the device 10 is to be applied. After transfer, the carrier strip 17 is removed leaving the security device 10 exposed. Alternatively the carrier strip 17 can be left in place to provide an outer protective layer.

Following the application/incorporation of the security device 10 the security document 11 generally undergoes further standard security printing processes including one or more of the following; wet or dry lithographic printing, intaglio printing, letterpress printing, flexographic printing, screen-printing, and/or gravure printing. In a preferred embodiment, and to increase the effectiveness of the security device 10 against counterfeiting, the design of the security device 10 can be linked to the document 11 it is protecting by content and registration to the designs and identifying information provided on the document 11.

Although all types of coloursHifting materials and structures may be used in the present invention, including inter alia liquid crystals, thin film interference structures, and photonic crystal structures, a particularly suitable material for the coloursHifting layers 12,13 are multilayer polymeric films such as described in EP-A-1047549, US-B-5089318 and WO-A-9619377. The invention is also not limited to the use of films and the layers 12, 13 for example, can be provided by pigmented coatings for example a pigmented liquid crystal coating applied to a carrier strip of a suitable polymeric substrate such as Polyethylene Terephthalate (PET) or Bi-axially oriented polypropylene (BOPP).

Liquid crystal films which would be suitable for use in the present invention would generally have a 20-25% light reflectance, although this is polarisation selective so a maximum 50% is achievable. Multilayer polymeric films generally have higher light reflectances and can be greater than 50%, and even approaching 100%. This means that the latent image and coloursHift effects will be brighter for such films over liquid crystal.

The chemical mechanical durability of multilayer polymeric films is also better than that of liquid crystal films. In particular the liquid crystal films can be frangible, unless protected by additional protective layers, making them vulnerable to physical hazards when security documents incorporating them are in circulation. However the additional of extra layers adds to the cost and time of production and adds additional bulk to the device 10.

When light strikes the coloursHifting layers 12,13, some of the light is reflected. The wavelength of the reflected light'depends on the structure and composition of the coloursHift material/structure and the reflected light will appear coloured. The wavelength of the reflected light is also dependent on the angle of incidence, which results in a colour change perceived by the viewer as the coloursHifting layer is tilted away from the normal.

In all of the embodiments now to be described in the coloursHifting layer is a multilayer polymeric film which is typically self-supporting and does not require the use of a carrier substrate. If a coloursHifting film is used which is not self-supporting, then a polymeric base film may be used as a carrier film.

In one embodiment of the invention the first coloursHifting layer 12 is a multilayer polymeric film of alternating layers of polyester and polymethylmethacrylate, and selected to have approximately 140 to 150 layers, each layer having a thickness of approximately 0.1 microns, resulting in a total film thickness of approximately 15 microns. In this example the film 12 exhibits a green colour when viewed along normal incidence and shifts to blue as the viewing direction is changed away from normal incidence.

The partial absorbing layer 14 is applied to one surface of the film 12, preferably by printing an ink using a suitable printing method such as gravure, screen, flexographic or lithographic printing, and preferably in the form of a design.

A laminating adhesive 19 is applied over the partial absorbing layer 14 and the exposed regions of the first fist colourshifting layer 12 to enable the second coloursfhifting layer 13 to be laminated thereto. The second coloursfhifting layer 13 is different from the first coloursfhifting layer 12 and has a different coloursfhift effect, for example exhibiting a red to green coloursfhift as the viewing angle is changed away from normal incidence.

A second, preferably full, layer 15 of light absorbing material is then applied, again preferably by gravure or another suitable printing process, to the exposed surface of the second layer 13, i.e. the opposing surface to the one brought into contact with the adhesive 19.

In other embodiments the second light absorbing material may also be applied in the fron of a pattern or design.

The absorbing layers 14,15 of the present invention may comprise a pigmented ink or coating or alternatively a non-pigmented absorbing dye can be used. They may also comprise magnetic ink. The colour of the first absorbing layer 14 is selected to match the normally reflected colour of the second coloursfhifting layer 13 when viewed against the second absorbing layer 15. Thus if the second coloursfhifting layer 13 is red to green and the second absorbing layer 15 is black, the normally reflected colour will be dark red and that is the colour selected for the first absorbing layer 14.

In order to improve the appearance of the reverse side of the security device 10 a full metal layer 20 may be applied thereto by printing with a metal or metal effect ink, for example an aluminium loaded ink. Alternatively a metal layer may be deposited using an evaporating technique.

Adhesive layers 19 may be applied to the outer surfaces of the device 10 to improve adherence to the secure document 11.

The application of a partial absorbing layer 14 between the two coloursfhifting layers 12,13 creates two optically variable regions, Regions A and B. In Region A there is no absorbing layer between the two coloursfhifting layers 12,13 such that the wavelength of reflected light, at any given angle of incidence, is a result of the additive mixing of the individual wavelengths of light reflected from the two coloursfhifting layers 12,13. In this example where layer 12 exhibits a green to blue coloursfhift and layer 13 exhibits a red to green coloursfhift the reflected light from Region A will appear yellow from the combination of green and red. In Region B there is an absorbing layer 14, which in this example is red, between the two multilayer films 12,13 and the wavelength of reflected light, at any given angle of incidence, is solely the reflected light from the second multilayer film 13 as influenced by the colour of the underlying regions of the partial absorbing layer 14. As the colour of the first absorbing layer 14 matches the colour of the light reflected by the combination of the second coloursfhifting layer and the second absorbing layer 15, the security device 10 has a uniform yellow appearance at normal incidence.

However, when the security device 10 is tilted at an angle away from normal, (i.e. the viewing angle is changed away from normal incidence), the first coloursfhifting layer 12 now reflects blue light, which will appear as magenta in regions B when viewed over the underlying regions of the red absorbing layer 14. The second coloursfhifting layer 15 reflects green light, so the regions A will appear turquoise as a result of the additive mixing of the individual wavelengths of the blue and green light reflected from the two coloursfhifting layers 12,13 respectively.

Consequently the security device 10 has a latent security feature which is not visible when the device is viewed at a normal angle of incidence. However a plurality of magenta regions B corresponding to the partial absorbing layer 14 will become visible in a turquoise background. A plan view of a typical security device is shown in FIGS. 2*b* and 2*c*. In this case the partial absorbing layer 14 forms the characters "DLR" (region B) and the background is provided by region A. When viewing at normal incidence regions A and B appear yellow and the characters "DLR" are hidden. On changing the viewing angle away from normal incidence the "DLR" characters change from yellow to magenta and the background region changes from yellow to turquoise resulting in the revealing of the "DLR" characters.

In another embodiment of the invention shown in FIG. 2*d* the second absorbing layer 15 under the second film 13 may be applied in the form of a design, creating a further optically variable Region C. In Region C there is no absorbing layer under either of the films 12,13, and when the device 10 is positioned on a reflective background, the intensity of the transmitted colour reflected back through the films 12,13 saturates the reflective colour. The transmitted and reflected colours are complementary, for example, a red to green coloursfhift in reflection is seen as a cyan to magenta coloursfhift in transmission. When the security device 10 is applied to a predominantly white substrate, then the light transmitted through Region C gives the underlying substrate a noticeable tint of colour which is the complementary colour to the observed reflected colour in Region A.

The designs generated by the partial application of one or more of the absorbing layers 14,15 are preferably in the form of images such as patterns, symbols and alphanumeric characters and combinations thereof. The designs can be defined by patterns comprising solid or discontinuous regions which may include for example line patterns, fine filigree line patterns, dot structures and geometric patterns. Possible characters include those from non-Roman scripts of which examples include but are not limited to, Chinese, Japanese, Sanskrit and Arabic.

In a further embodiment one or both of the films 12,13 is a partial layer. Where the second film 13, for example, is a partial layer, such that in certain regions the first film 12 is exposed, then a further optically variable region can be created in which the wavelength of reflected light, at any given angle of incidence, is solely the reflected light from the first film 12.

The use of a multilayer polymer film as the second coloursfhifting layer 13, where only one component of the coloursfhift is in the visible region of the electromagnetic spectrum, also enables a latent image to be incorporated into the device 10 that only becomes apparent at certain angles of view.

Thus the colour of the first partial absorbing layer 14 will need to be identical to the colour of the second absorbing layer 15 in order for it to match the reflected "colour" from the second layer 13 and second absorbing layer 15. In one example, illustrated in FIGS. 3 and 4, and referring to the cross-section in FIG. 2*a*, the second layer 13 reflects light in the infrared region of the electromagnetic spectrum when at normal incidence (FIG. 3), which is colourless and transparent, and reflects red light when tilted away from normal incidence (FIG. 4). The first film 12 exhibits a green-blue coloursHift and when viewed at normal incidence over a dark background, this brings out a strong dark green colour.

Regions A and B are defined by the partial black absorbing layer 14 between the two films 12, 13 which, in this example, is applied in the form of alphanumeric characters such that Region B is a repeating pattern of the words DE LA RUE (RTM) and Region A is the background. When viewed in reflection at normal incidence both Regions A and B will appear dark green due to the transparent colourless appearance of the second film 13 having no visible effect on the appearance of the device 10. On tilting the device 10 such that it is viewed away from normal incidence Region A appears magenta, due to the additive colour mixing from the blue reflected light from the film 12 and the red reflected light from the second film 13, and Region B appears blue due to the reflected light coming solely from the first film 12. To the authenticator the device 10 appears uniformly green at normal incidence but on tilting away from normal incidence the repeating legend DE LA RUE appears in a magneta colour against a blue background.

The security device 10 can be used in combination with existing approaches for the manufacture of threads. Examples of suitable methods and constructions that can be used include, but are not limited to, those cited within WO-A-03061980, EP-A-516790, WO-A-9825236, and WO-A-9928852. Security devices comprising coloursHifting layers such as multilayer polymer films are machine-readable using a spectrophotometer. The machine readable-aspect of the security device 10 of the present invention can be extended further by the introduction of detectable materials in the absorbing layers 14,15 or by the introduction of separate machine-readable layers. Detectable materials that react to an external stimulus include but are not limited to fluorescent, phosphorescent, infrared absorbing, thermochromic, photochromic, magnetic, electrochromic, conductive and piezochromic materials. In one preferred embodiment, the pigment in one of the absorbing layers 14,15 is machine readable, for example carbon black, to produce a machine-readable or conducting layer. Alternatively it may be a magnetic material, such as magnetite, to produce a machine-readable magnetic layer.

In an alternative machine-readable construction one or more of the absorbing layers 14,15 can be formed using a magnetic pigment, for example magnetite. For example the partial absorbing layer 14 in FIG. 2*a* can be formed from such a magnetic pigment to provide a machine-readable code.

In a further embodiment, only part of the partial absorbing layer 14 in FIG. 2*a* is provided with a magnetic pigment and the remainder is provided with a non-magnetic pigment. If both the magnetic and non-magnetic regions are substantially totally absorbing there will be no visual difference in the liquid crystal layer over the two regions and therefore the format of the code will not be readily apparent.

In an alternative machine-readable embodiment a transparent magnetic layer can be incorporated at any position within the structure of the device 10. Suitable transparent magnetic layers containing a distribution of particles of a magnetic material of a size and distributed in a concentration at which the magnetic layer remains transparent are described in WO-A-03091953 and WO-A-03091952.

As a further alternative, the security device of the current invention may incorporate substrate of a polymeric material, such as Polyethylene Terephthalate (PET) or Bixally Oriented Polypropylene (BOPP). This polymeric substrate may be metallised, for example using vapour deposition and subsequently demetallised to form negative or positive indicia as described for example in EP-A-0319157. Alternatively metallic inks could be used instead of vapour deposited metal layers. A magnetic material in the form of tramlines may be applied along both longitudinal edges of the carrier substrate, which optionally may have been previously metallised. A suitable magnetic material is FX 1021 supplied by Ferron and this may be applied with a coat weight of, for example, 2-6 gsm. The polymeric substrate with the metallised and/or magnetic layers is then laminated to absorbing layer 15 in the structures shown in FIG. 2*a*. The use of magnetic tramlines in this example is for illustrative purposes only, and the magnetic material may be applied in any design.

In all of the embodiments described, where the finished security document 11 has undergone further standard security printing processes, e.g. litho and intaglio, then the colour and/or design of the images/information on the security device 10 can be correlated to the design of the final printed document 11. The patterns and designs on the device 10 and document 11 may be registered with each other, which makes it very difficult to counterfeit.

The invention claimed is:

1. A security device, comprising:

a first color-shifting layer;

a second color-shifting layer having a reflective characteristic different than a reflective characteristic of the first color-shifting layer, the first and second color-shifting layers exhibiting a visible color at normal incidence;

a first light absorbing layer between first surfaces of the first and second color-shifting layers such that a first region is formed where the first absorbing layer is not between the first and second color-shifting lavers and a second region where the first light absorbing layer lies between the first and second color-shifting layers; and a second light absorbing layer on a second surface of the second color-shifting layer, wherein the first absorbing layer has a color selected to substantially match a color of light reflected at a normal angle of incidence by the second color-shifting layer combined with the second absorbing layer so that when the security device is viewed at an angle which is away from the normal angle of incidence the first and second regions are of a color that is different to that observed at normal incidence for the respective region.

2. The security device as claimed in claim 1, wherein the first and/or second color-shifting layers are partial layers.

3. The security device as claimed in claim 1, wherein the second light absorbing layer is a partial layer.

4. The security device as claimed in claim 1, wherein the first and/or second light absorbing layers form indicia.

5. The security device as claimed in claim 4, wherein the indicia comprises one or more indicia selected from the group consisting of a design, a pattern, a symbol, an alphanumeric character, and any combinations thereof.

6. The security device as claimed in claim 1, wherein the first and second light absorbing layers are formed from a pigmented ink or a coating.

7. The security device as claimed in claim 1, wherein the first and second light absorbing layers are formed from a non-pigmented dye.

8. The security device as claimed in claim 1, wherein light reflected by one of the first or second color-shifting layers, at certain angles of view, is in a non-visible wavelength of the electromagnetic spectrum.

9. The security device as claimed in claim 8, wherein light reflected by the first color-shifting layer, at certain angles of view, is in an infrared region of the electromagnetic spectrum.

10. The security device as claimed in claim 1, further comprising a machine readable element.

11. The security device as claimed in claim 10, wherein the machine readable element is in the first and/or second light absorbing layers.

12. The security device as claimed in claim 10, wherein the machine readable element comprises a material selected from the group consisting of a fluorescent material, a phosphorescent material, an infrared absorbing material, a thermochromic material, a photochromic material, a magnetic material, an electrochromic material, a conductive material, and piezochromic material.

13. The security device as claimed in claim 1, wherein the first and/or second color-shifting layers are liquid crystal layers.

14. The security device as claimed in claim 1, wherein the first and/or second color-shifting layers are multilayer polymer films.

15. A security document comprising a substrate and the security device as claimed in claim 1.

16. The security document as claimed in claim 15, wherein the security device is applied to a surface of the substrate.

17. The security document as claimed in claim 15, wherein the security device is at least partially embedded in the substrate and is visible in windows in at least one surface of the substrate.

18. A security device, comprising:

a first color-shifting layer having a first reflective characteristic;

a second color-shifting layer having a second reflective characteristic, the second reflective characteristic being different than the first reflective characteristic, the first and second color-shifting layers exhibiting a visible color at normal incidence;

a first light absorbing layer between first surfaces of the first and second color-shifting layers such that a first region is formed where the first absorbing layer is not between the first and second color-shifting layers and a second region where the first light absorbing layer lies between the first and second color-shifting layers; and a second light absorbing layer on a second surface of the second color-shifting layer, the second color-shifting layer comprising a multilayer polymer, wherein the first absorbing layer has a color selected to substantially match a color of light reflected at a normal angle of incidence by the second color-shifting layer combined with the second absorbing layer so that when the security device is viewed at an angle which is away from the normal angle of incidence the first and second regions are of a color that is different to that observed at normal incidence for the respective region.

19. The security device as claimed in claim 18, wherein the first and/or second color-shifting layers are partial layers.

20. The security device as claimed in claim 18, wherein the second light absorbing layer is a partial layer.

21. The security device as claimed in claim 18, wherein the first and/or second light absorbing layers form indicia.

22. The security device as claimed in claim 21, wherein the indicia comprises one or more indicia selected from the group consisting of a design, a pattern, a symbol, an alphanumeric character, and any combinations thereof.

23. The security device as claimed in claim 18, wherein the first and second light absorbing layers are formed from a pigmented ink or a coating.

24. The security device as claimed in claim 18, wherein the first and second light absorbing layers are formed from a non-pigmented dye.

25. The security device as claimed in claim 18, wherein light reflected by one of the first or second color-shifting layers, at certain angles of view, is in a non-visible wavelength of the electromagnetic spectrum.

26. The security device as claimed in claim 25, wherein light reflected by the first color-shifting layer, at certain angles of view, is in an infrared region of the electromagnetic spectrum.

27. The security device as claimed in claim 18, further comprising a machine readable element.

28. The security device as claimed in claim 27, wherein the machine readable element is in the first and/or second light absorbing layers.

29. The security device as claimed in claim 27, wherein the machine readable element comprises a material selected from the group consisting of a fluorescent material, a phosphorescent material, an infrared absorbing material, a thermochromic material, a photochromic material, a magnetic material, an electrochromic material, a conductive material, and piezochromic material.

30. The security device as claimed in claim 18, wherein the first and/or second color-shifting layers are liquid crystal layers.

31. The security device as claimed in claim 18, wherein the first and/or second color-shifting layers are multilayer polymer films.

32. A security document comprising a substrate and the security device as claimed in claim 18.

33. The security document as claimed in claim 32, wherein the security device is applied to a surface of the substrate.

34. The security document as claimed in claim 32, wherein the security device is at least partially embedded in the substrate and is visible in windows in at least one surface of the substrate.

35. A method of manufacturing a security device, comprising the steps of:

applying a layer of light absorbing material to a first color-shifting layer, the first color-shifting layer having a first reflective characteristic;

applying a second color-shifting layer to cover the layer of light absorbing material and exposed regions of the first color-shifting layer, the second color-shifting layer having a second reflective characteristic that is different than the first reflective characteristic; and applying a second layer of light absorbing material to cover an exposed surface of the second color-shifting layer, wherein the layer of light absorbing material has a color selected to substantially match a color of light reflected at a normal angle of incidence by the second color-shifting layer combined with the second layer so that when the security device is viewed at an angle which is away from the normal angle of incidence the first and second regions are of a color that is different to that observed at normal incidence for the respective region.

* * * * *